US006691975B1

(12) United States Patent
Gavin

(10) Patent No.: US 6,691,975 B1
(45) Date of Patent: Feb. 17, 2004

(54) CONCRETE TANK SEAL CAST

(76) Inventor: Norman W. Gavin, 173 Church St., Yalesville, CT (US) 06492

( * ) Notice: Subject to any disclaimer, the term of this patent is extended or adjusted under 35 U.S.C. 154(b) by 0 days.

(21) Appl. No.: 10/188,506

(22) Filed: Jul. 3, 2002

Related U.S. Application Data

(60) Provisional application No. 60/305,126, filed on Jul. 13, 2001.

(51) Int. Cl.[7] ..... E04G 15/00; F16L 5/02; F16L 21/025; B29C 33/76

(52) U.S. Cl. ..... 249/39; 249/10; 249/57; 249/183; 277/604; 277/606; 264/35; 264/36.15; 264/279.1

(58) Field of Search ..... 249/10, 11, 18, 249/57, 83, 177, 178, 96, 39, 183, 188; 264/32, 35, 36.1, 36.15, 274, 275, 279.1; 277/604, 606, 607, 626, 590, 917

(56) References Cited

U.S. PATENT DOCUMENTS

| | | | | |
|---|---|---|---|---|
| 1,036,697 | A | | 8/1912 | Pereival |
| 1,484,426 | A | | 2/1924 | Thompson |
| 3,313,515 | A | | 4/1967 | Mullen, Jr. |
| 3,685,782 | A | | 8/1972 | Kowell |
| 3,985,482 | A | | 10/1976 | Suzuki |
| 4,296,909 | A | | 10/1981 | Haeussler |
| 4,650,149 | A | | 3/1987 | Poulette et al. |
| 4,732,397 | A | | 3/1988 | Gavin |
| 4,916,799 | A | | 4/1990 | Skinner et al. |
| 4,951,914 | A | | 8/1990 | Meyers et al. |
| 5,286,040 | A | | 2/1994 | Gavin |
| 5,492,656 | A | | 2/1996 | Tracy |
| 5,536,457 | A | | 7/1996 | Topf, Jr. |
| 5,624,123 | A | | 4/1997 | Meyers |
| 5,941,535 | A | | 8/1999 | Richard |
| 6,450,505 | B1 | * | 9/2002 | Gavin ..... 277/606 |
| 6,460,860 | B2 | * | 10/2002 | Gavin ..... 277/604 |
| 6,568,691 | B1 | * | 5/2003 | Westhoff et al. ..... 277/604 |

FOREIGN PATENT DOCUMENTS

| | | | | |
|---|---|---|---|---|
| DE | 3137981 | * | 4/1983 | ..... 264/275 |

* cited by examiner

*Primary Examiner*—Jong-Suk (James) Lee
(74) *Attorney, Agent, or Firm*—Robert A. Seemann

(57) ABSTRACT

A closed end of a one piece flexible elastomeric seal is mounted in one end of a tubular liquid concrete tight frame that is mounted on a removable door of one wall of a concrete wall mold, the other open end of the flexible seal is in liquid concrete tight sealing contact with the other wall of the concrete wall mold.

26 Claims, 15 Drawing Sheets

CONCRETE TANK SEAL CAST

This application claims the benefit of U.S. Provisional Application No. 60/305,126, filled Jul. 13, 2001.

BACKGROUND OF THE INVENTION

1. Field of the Invention

The invention pertains to casting a pipe seal in the wall of a concrete vessel for use in low pressure installations as for example, septic field distribution boxes and septic tanks. More specifically to an apparatus that mounts on a closure in one wall of the mold for molding a wall of the vessel and holds the seal between the walls of the wall mold.

2. Description of the Prior Art

U.S. Pat. No. 5,286,040 patented Feb. 15, 1994, by N. Gavin, describes designs for casting a pipe seal in the concrete wall of a septic tank. A hinged door on one wall of a concrete wall mold contains a closed cup shaped protrusion. A frustoconical plastic seal fits continuously over the closed bottom and frustoconical side wall of the cup and turns backward in a cylinder that extends from the larger diameter end of the frustoconical portion of the seal past the smaller end of the frustoconical portion of the seal.

When the door is closed, the cup positions the free end of the cylinder against the opposite wall of the concrete wall mold. When the concrete hardens, the door is opened, drawing the cup out of the concrete wall, leaving a conical opening in the concrete wall from the larger end of the cup leading to the open larger diameter end of the frustoconical seal.

The cylinder portion of the seal then lines the rest of the opening in the wall which is sealed by the frustoconical portion of the seal. Integrally molded portions of the seal comprising radially extending arms 31 ending in hollow cylindrical bosses that extend parallel to the axis of the seal (FIGS. 2–4) and annular radially extending flange 26 ending in axially extending rim 28 provide mounting points on the concrete wall and a cast-in anchor. U.S. Pat. No. 5,286,040, patented Feb. 15, 1994, is hereby incorporated by reference.

Additional designs for casting low pressure pipe seals in the concrete wall of a septic tank are described in U.S. Pat. No. 4,951,914, patented Aug. 28, 1990, by Meyers et at., 5,624,123, patented Apr. 29, 1997, by Meyers, and U.S. Pat. No. 5,941,535, patented Aug. 24, 1999, by Richard.

SUMMARY OF THE INVENTION

It is one object of the invention to mold a seal in a concrete wall of a vessel.

It is another object of the invention to mount the seal within a frustoconical frame designed for mounting on the door portion, or movable portion of one wall of a concrete wall mold.

In a mold for a concrete container for use in a low pressure septic system, a seal cast system includes: a first mold wall, a second mold wall spaced from the first mold wall for receiving liquid concrete between the first mold wall and the second mold wall for forming a concrete wall of the container, a stiff tubular frame having a first end, a second end, and an axis through the first end and the second end, the first end of the frame attached sealingly to the first mold wall between the first mold wall and the second mold wall, the frame extending axially toward the second mold wall, a one piece molded flexible tubular seal comprising a first end in the tubular frame, the seal extending axially from a second end of the tubular frame toward the second mold wall, a second, open end of the flexible seal sealingly contacting the second mold wall, the second end of the tubular frame extending toward the second wall into an annular recess on the seal formed by a portion of the seal folding back from the second end of the seal toward the first end of the seal, to the bottom of the recess, and radially extending means, molded on the seal, for anchoring the seal in the concrete wall when the concrete wall is formed by the first and second mold walls. Preferably the second end of the frame is smaller than the first end of the frame, and the second end of the tubular seal is larger than the first end of the tubular seal.

A plurality of fasteners extending through said first mold wall into said frame are spaced radially from the axis.

The first end of the tubular seal is closed, and the seal includes an annular notch in the seal around the axis adjacent to the first end of said tubular seal for removing the closed end of the seal.

Other objects and advantages of the invention will become apparent to persons skilled in the art from reading the ensuing description.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
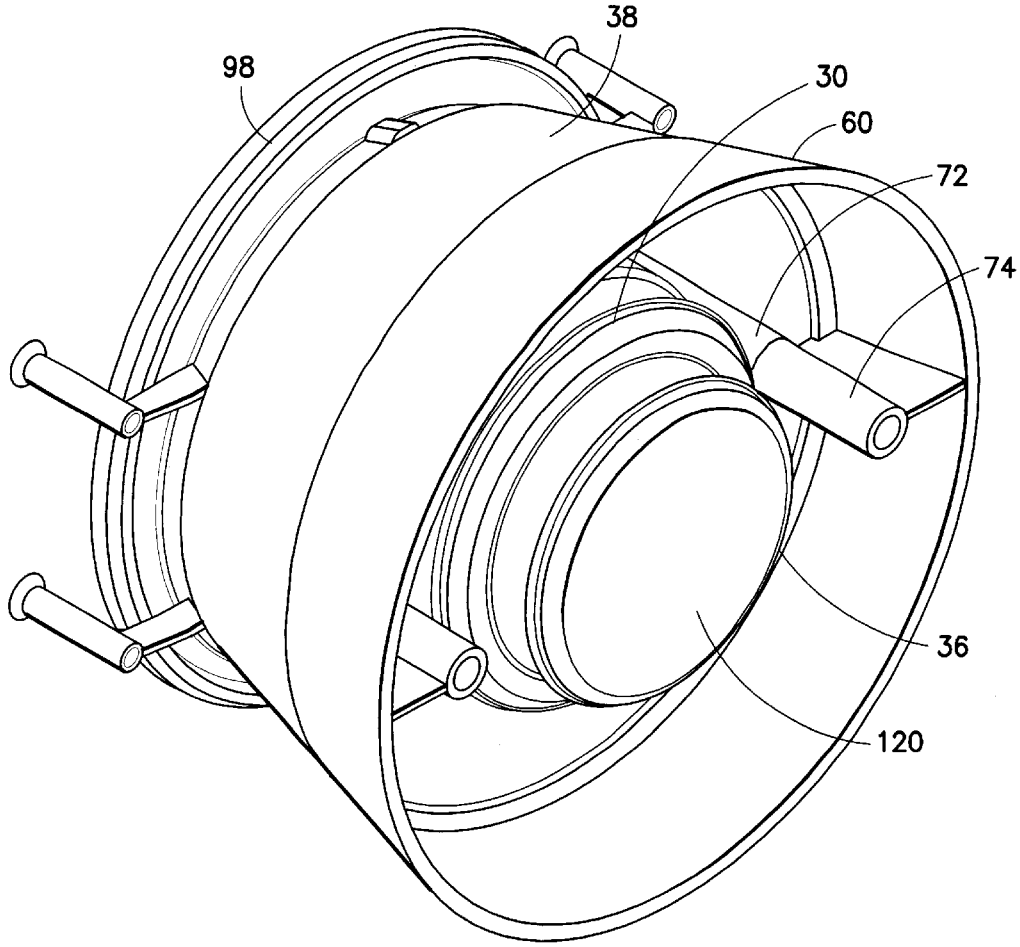
FIG. 1 is a perspective view of a seal mounted in a frame according to the invention, viewed from the front of the seal or front of the frame.
Figure 2:
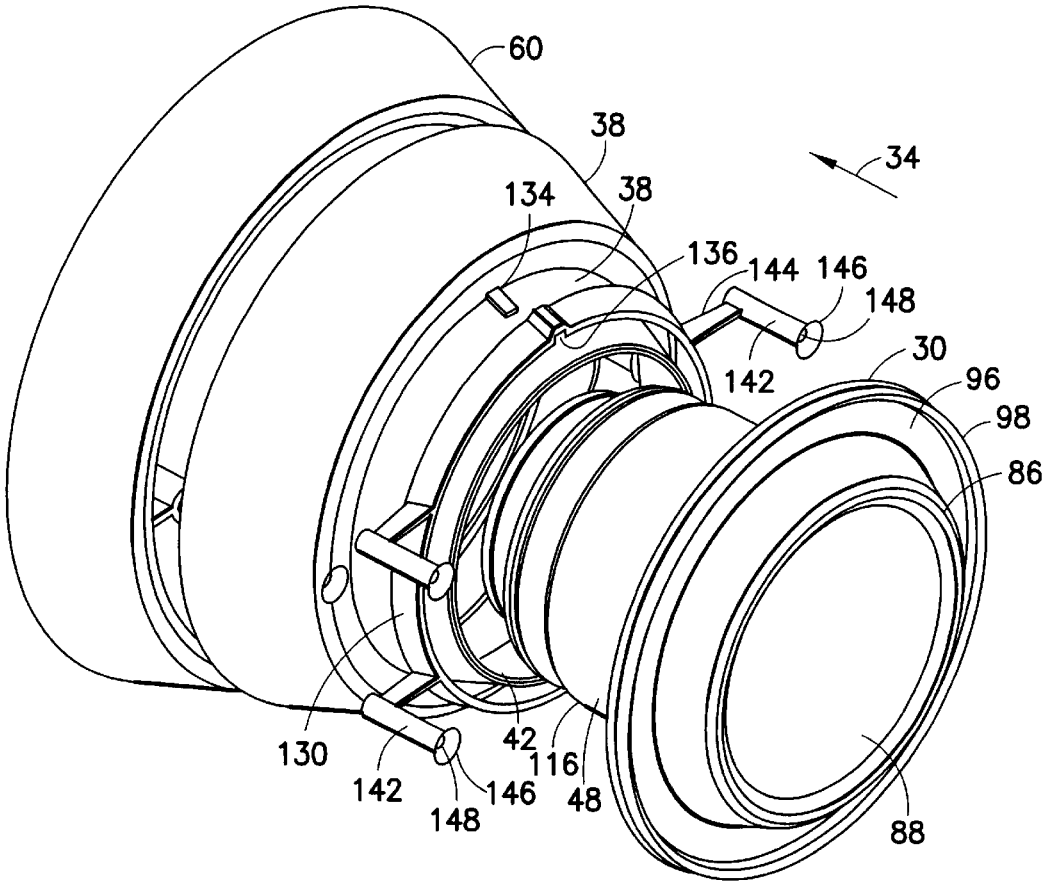
FIG. 2 is a perspective exploded view of the seal and frame of FIG. 1, viewed from the back of the seal or back of the frame.
Figure 3:
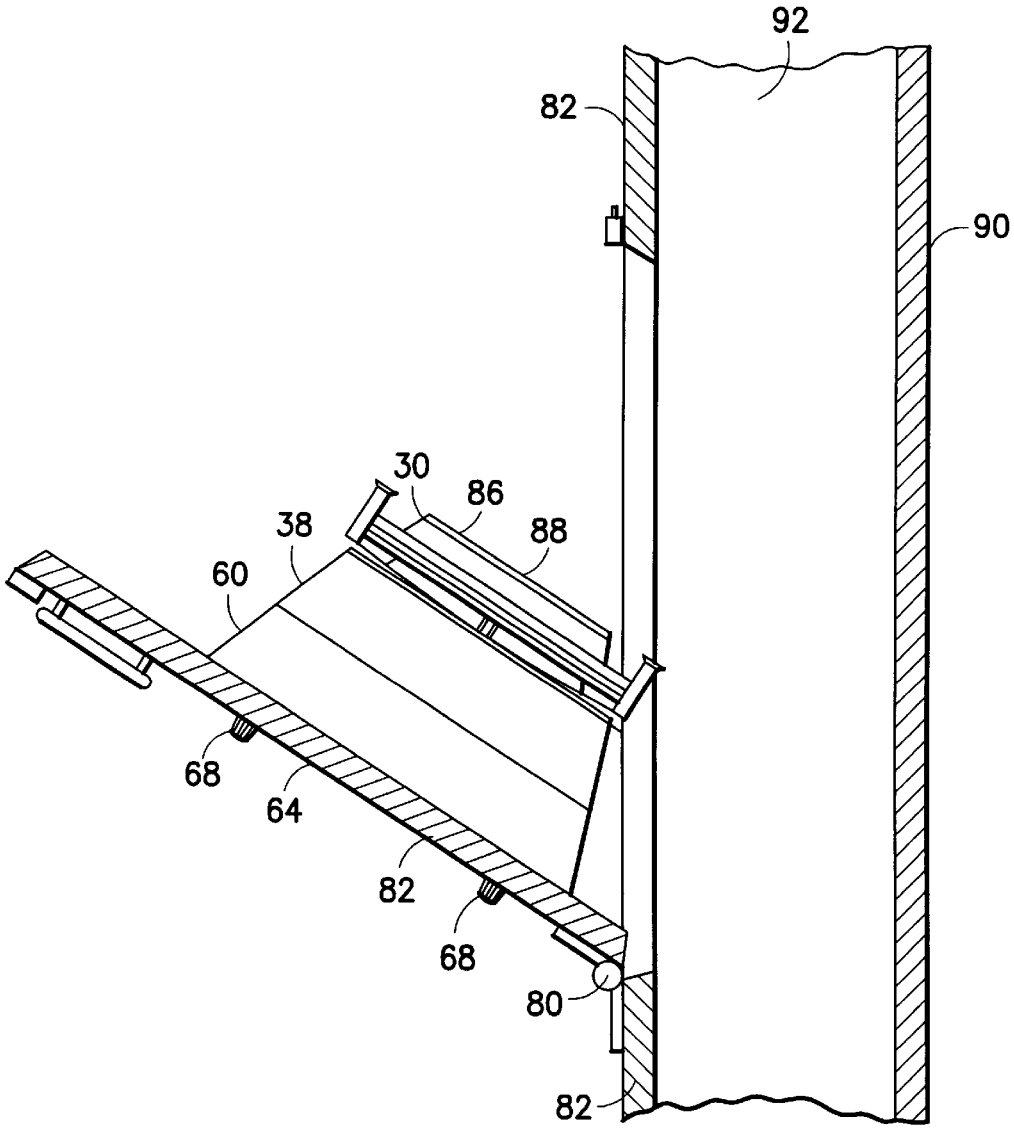
FIG. 3 is a schematic view of the seal and frame of FIG. 1 mounted on a door of a mold of a concrete wall, the door being open.
Figure 4:
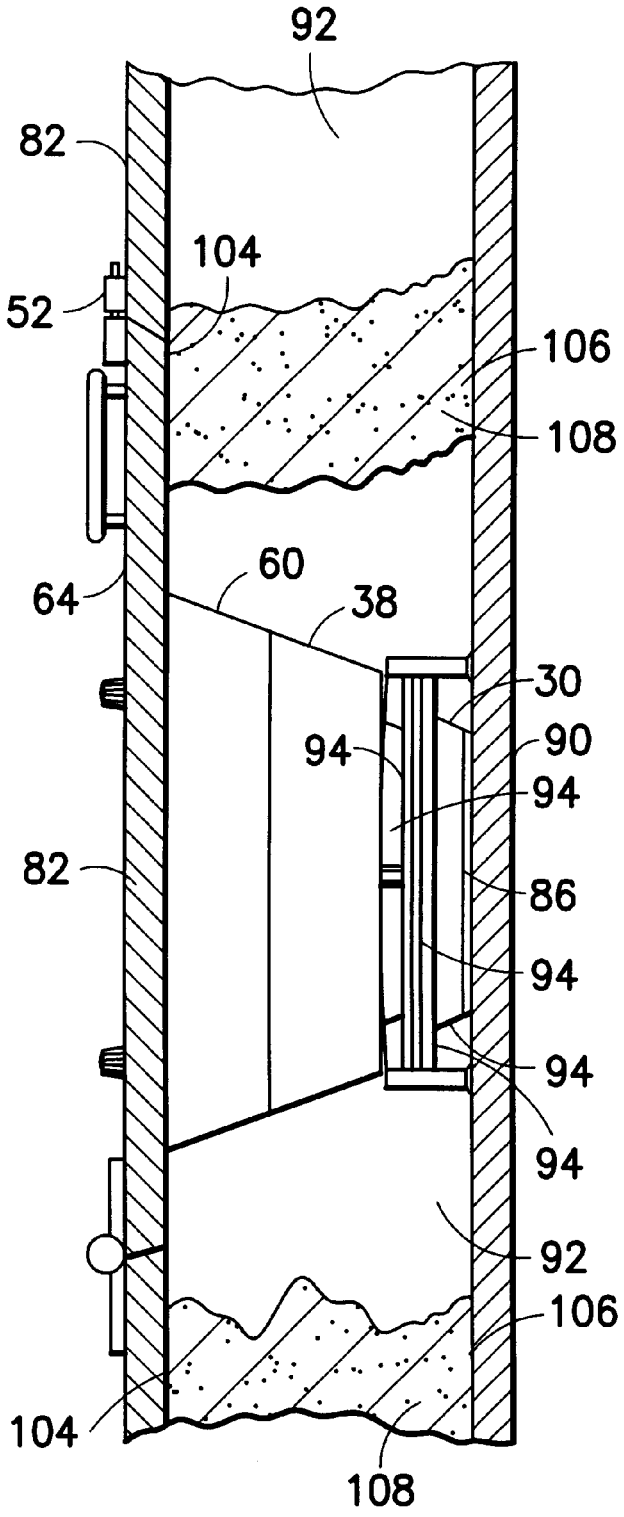
FIG. 4 is a schematic view of the seal and frame of FIG. 1 mounted on the door of the mold of FIG. 3, the door being closed. The concrete wall molded therein is shown in fragmentary view.
Figure 5:
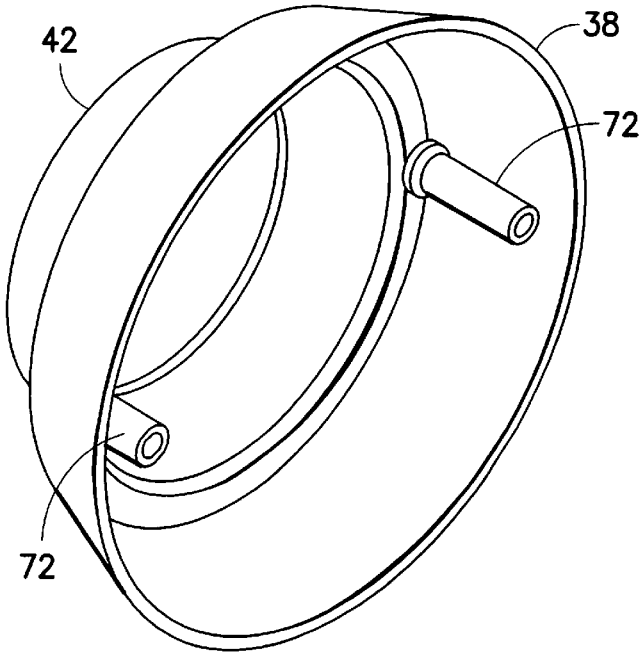
FIG. 5 is a perspective front view of a first frame element of the frame of FIG. 1.
Figure 6:
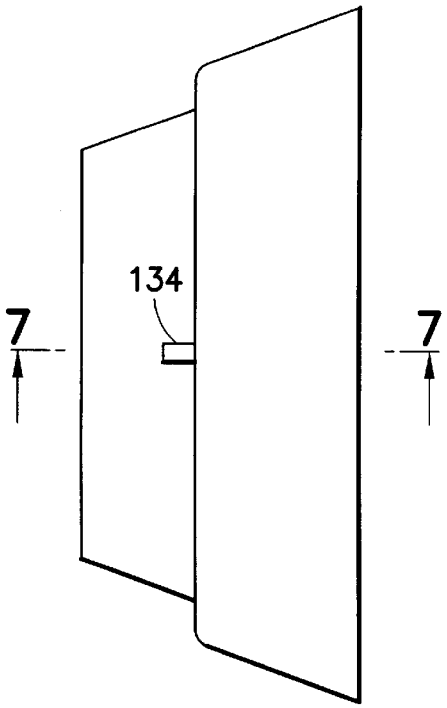
FIG. 6 is a side view of the first frame element of FIG. 5.
Figure 7:
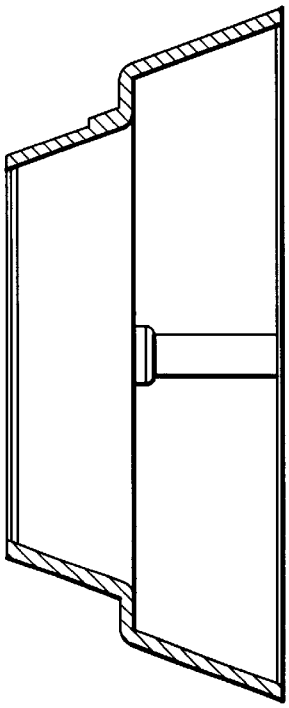
FIG. 7 is a cross section view of the first frame element of FIG. 6 taken along 7—7.
Figure 8:
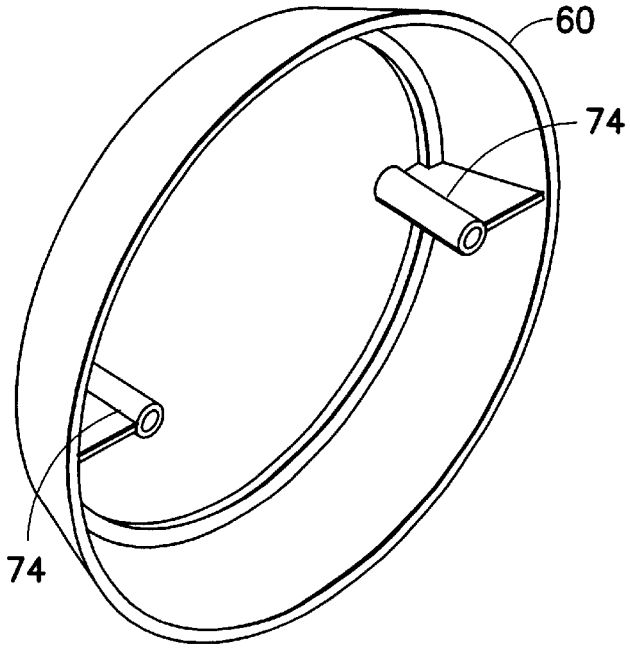
FIG. 8 is a perspective front view of a second frame element of the frame of FIG. 1.
Figure 9:
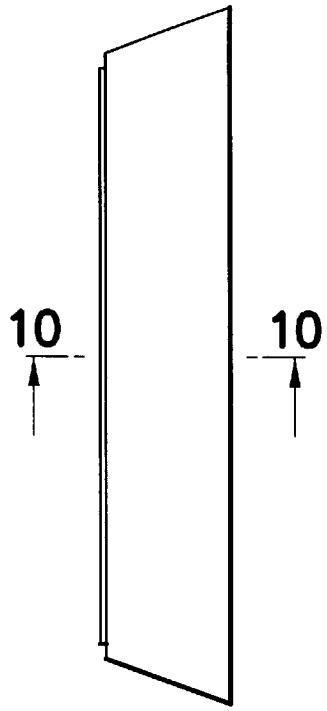
FIG. 9 is a side view of the second frame element of FIG. 8.
Figure 10:
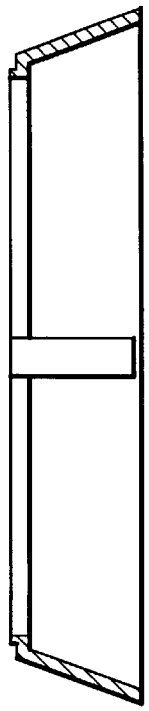
FIG. 10 is a cross section view of the second frame element of FIG. 9 taken along 10—10.
Figure 11:
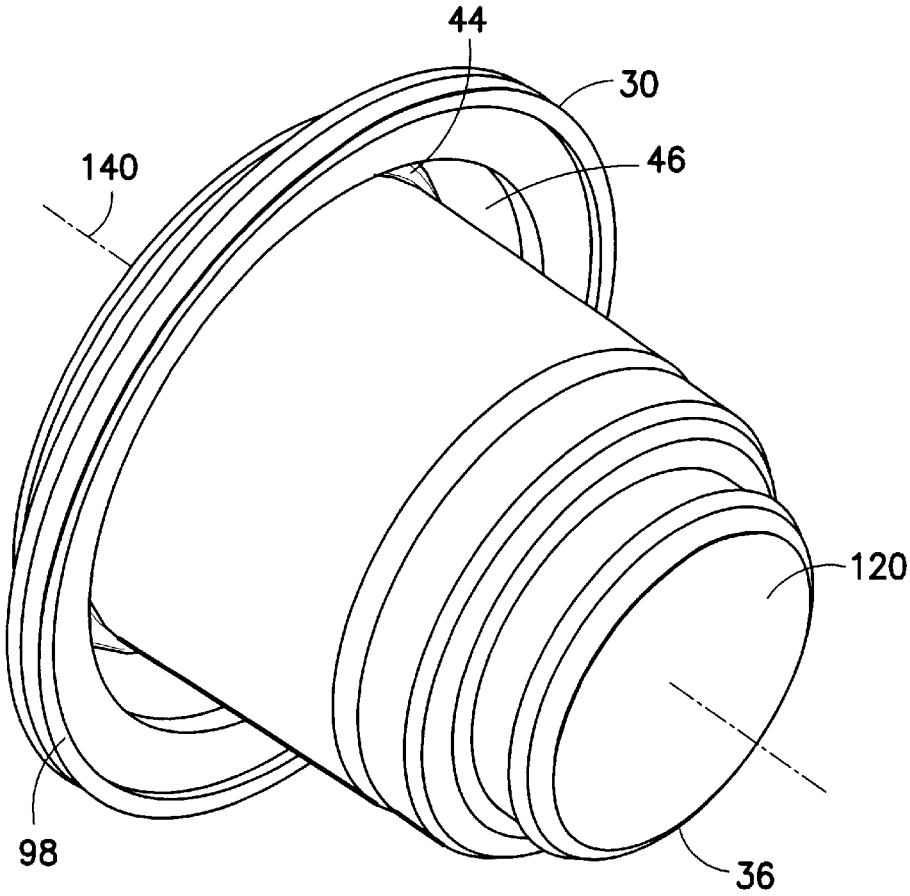
FIG. 11 is a perspective view of the seal of FIG. 1 viewed from the front of the seal.
Figure 12:
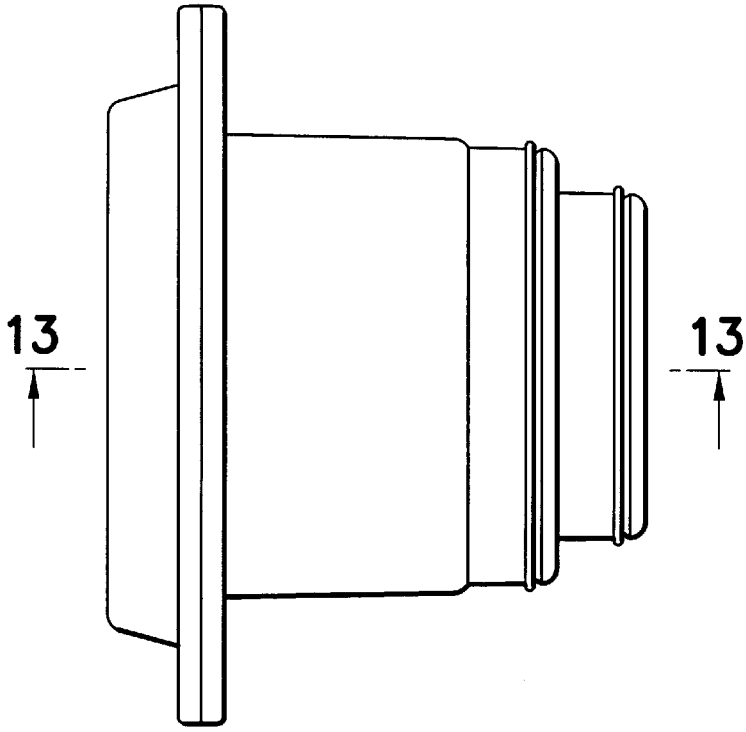
FIG. 12 is a side view of the seal of FIG. 11.
Figure 13:
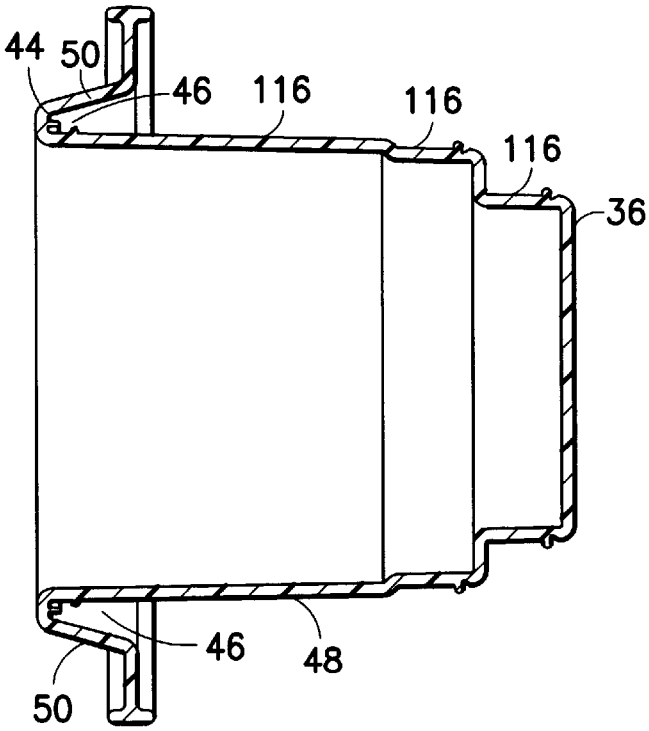
FIG. 13 is a cross section view of the seal of FIG. 12 taken along 13—13.
Figure 14:
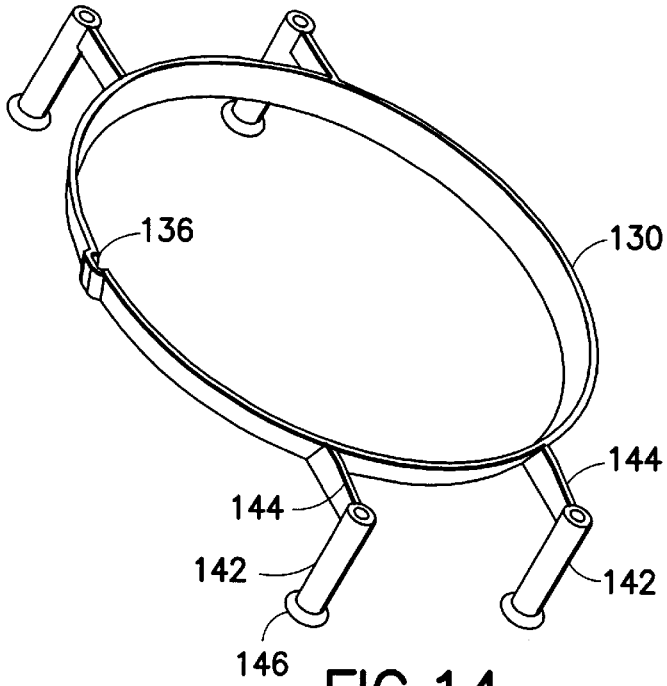
FIG. 14 is a perspective front view of the stud receiver of FIG. 2, which slips on the first frame element.
Figure 15:
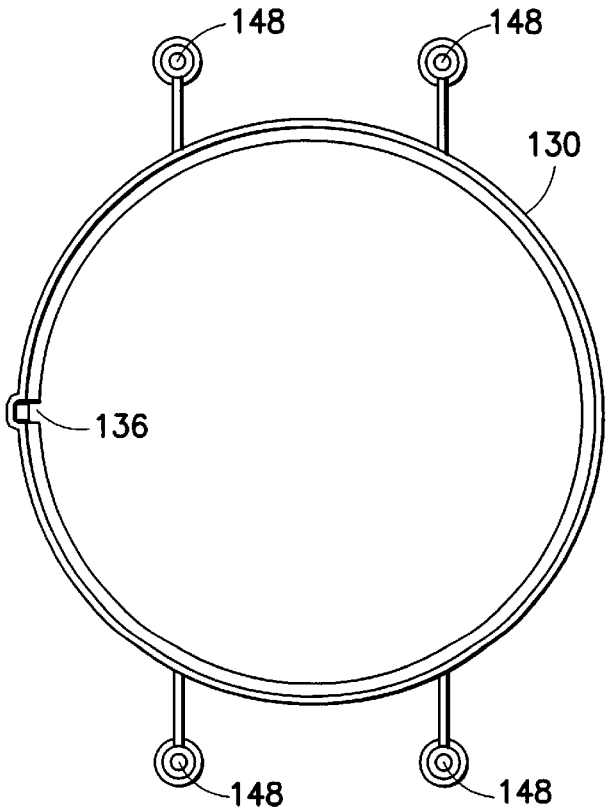
FIG. 15 is a front view of the stud receiver of FIG. 14.
Figure 16:
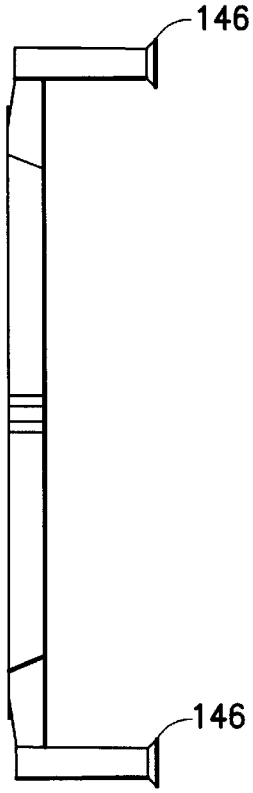
FIG. 16 is a side view of the stud receiver of FIG. 14.
Figure 17:
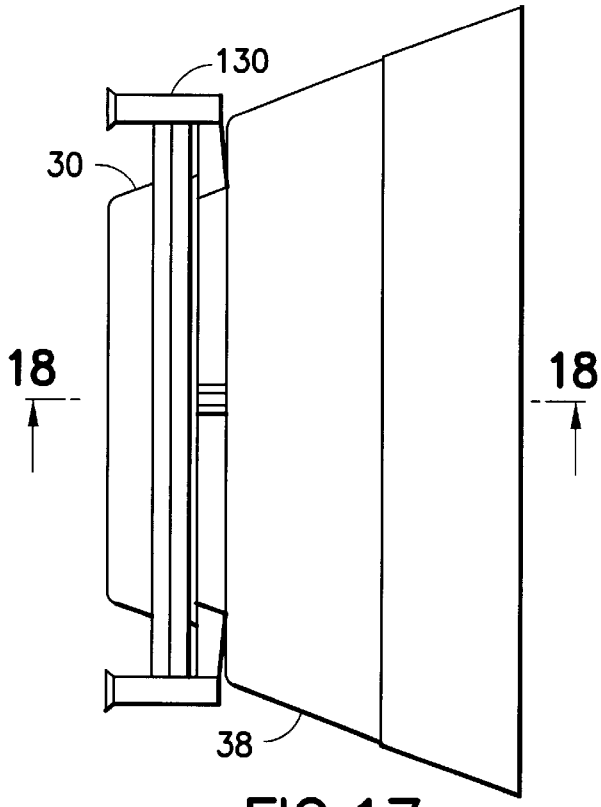
FIG. 17 is a side view of the seal and frame assembly of FIG. 1.
Figure 18:
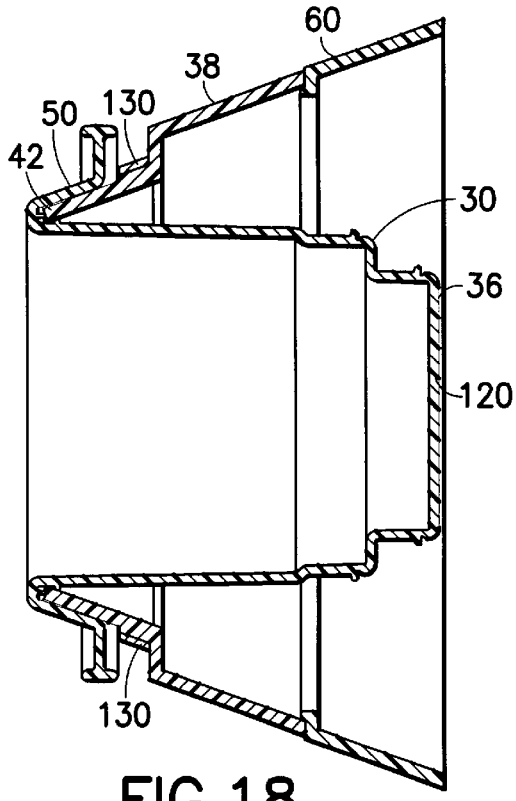
FIG. 18 is a cross section view of the assembly of FIG. 17 taken along 18—18.
Figure 19:
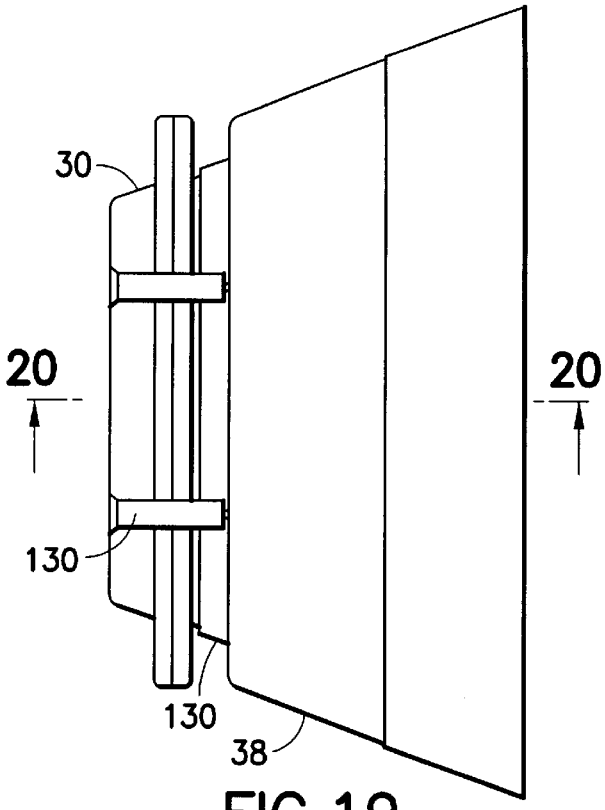
FIG. 19 is a side view of the seal and frame assembly of FIG. 17 rotated 90 degrees.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

This application claims the benefit of U.S. Provisional application No. 60/305,126, filed Jul. 13, 2001, which is hereby incorporated by reference.

The illustrated molded seal 30, as best seen in FIGS. 13, 18, 20 and 21, is of a generally annular configuration. It includes a first generally cylindrical wall 48 and a second wall 50 that is in the form of a truncated cone. The walls are connected by a juncture portion and define annular recess 46 having a bottom 44. The second wall 50 diverges from the juncture portion 42 in overlying relation to the first wall 48.

Referring to FIGS. 1–2, 5–13 and 17–22, seal 30 which is flexible plastic or rubber, molded in one piece, is inserted 34, front end 36 first, into one piece molded plastic frame 38 so that the back end 42 of frame 38 is received in the bottom 44 of annular recess 46 of the seal. Annular recess 46 is formed by wall 48 folding back from the back end of the seal in a wall 50 that extends toward the front of the seal. Annular wall 50 sealingly contacts frame 38 so that liquid concrete cannot enter between them.

Referring to FIGS. 1–4, one piece molded plastic frame 60 is sealingly attached to door 64 movable portion of wall 82 so that the seal is liquid concrete tight, that is, sufficent enough to prevent flow of liquid concrete through the seal between the door and frame 60.

Door 64 is mounted by hinge 80 on wall 82. Door 64 can be removed from wall 82 by rotating the door out of the wall on hinge 80. The door is fastened shut by latch 52.

Although a hinge is preferable, the door may be removably fastened in the wall without a hinge.

Frame 38 is sealingly attached to frame 60 by screw and nut fasteners 68 that pass serially through guides 72 in frame 38 and guides 74 in frame 60. Preferably the nuts are molded-in threaded inserts 70.

When door 64 is closed, back end 86 of the seal sealingly contacts mold wall 90 so that when liquid concrete is deposited in the space 92 between walls 82 and 90, the concrete forms around frames 60 and 38, and around exposed surfaces 94 of the seal including annular ring 96 extending radially from wall 50, and its outermost annular axially extending ridge 98.

When the door is opened after the concrete hardens, the door draws frames 60 and 38 out of seal 30. This leaves a concrete-faced interior opening extending from side 104 to side 106 of concrete wall 108. Part of the interior opening is lined by exposed surfaces 94 of the seal about from ring 96 to back end 86 of the seal. Back end 86 of the seal provides an opening 88 into the tubular portion 116 of the seal that is sealed by wall 120 at front end 36 of the seal. Ring 96 anchors the seal in the hardened concrete wall.

Frame 60 in the above example is omitted when molding thinner concrete walls.

The frame between the door and rubber or plastic seal can be a one-piece unit or can be stacked units like frame 60 attached to frame 38. Frames 60 and 38 are stiff so that they can resist the force of the liquid concrete against the sides of the frames. Frames 60 and 38 are preferably circular in cross section.

Referring to FIGS. 2–4, 6, and 14–20, if casting of plastic one piece molded, stiff, stud receiver 130 in the wall with the seal is desired, before closing door 64, the stud receiver is slipped on frame 38 so that guide 134 which extends radially from frame 38 is received in indexing slot 136 to prevent rotation of receiver 130 about axis 140 of seal 30. When the door is closed, back ends 146 of receiver heads 142 on extensions 144 sealingly contact mold wall 90 so that concrete does not enter openings 148 which provide openings for fasteners to attach items to the concrete wall.

Figure 20:
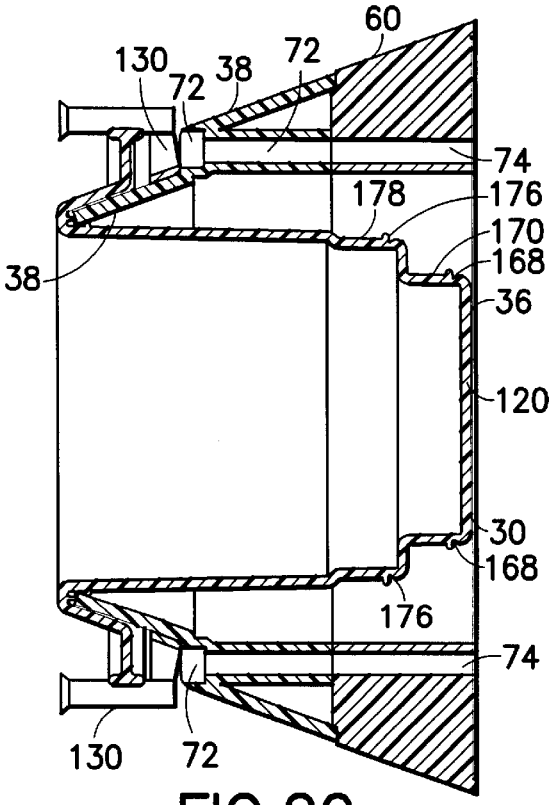
FIG. 20 is a cross section view of the assembly of FIG. 19 taken along 20—20.

Referring to FIG. 20, seal 30 is designed to receive pipe through the seal by tearing off wall 120 at annular notch 168 and tightening flexible tubular wall 170 on the pipe by a circular clamp. Larger diameter pipe is received and sealed on by the seal by tearing off wall 170 at annular notch 176 and clamping tubular wall 178 on the pipe. When walls 178, 170 and 120 are intact, preferably wall 120 is circular, and walls 178 and 170 are circular in cross section.

Figure 21:
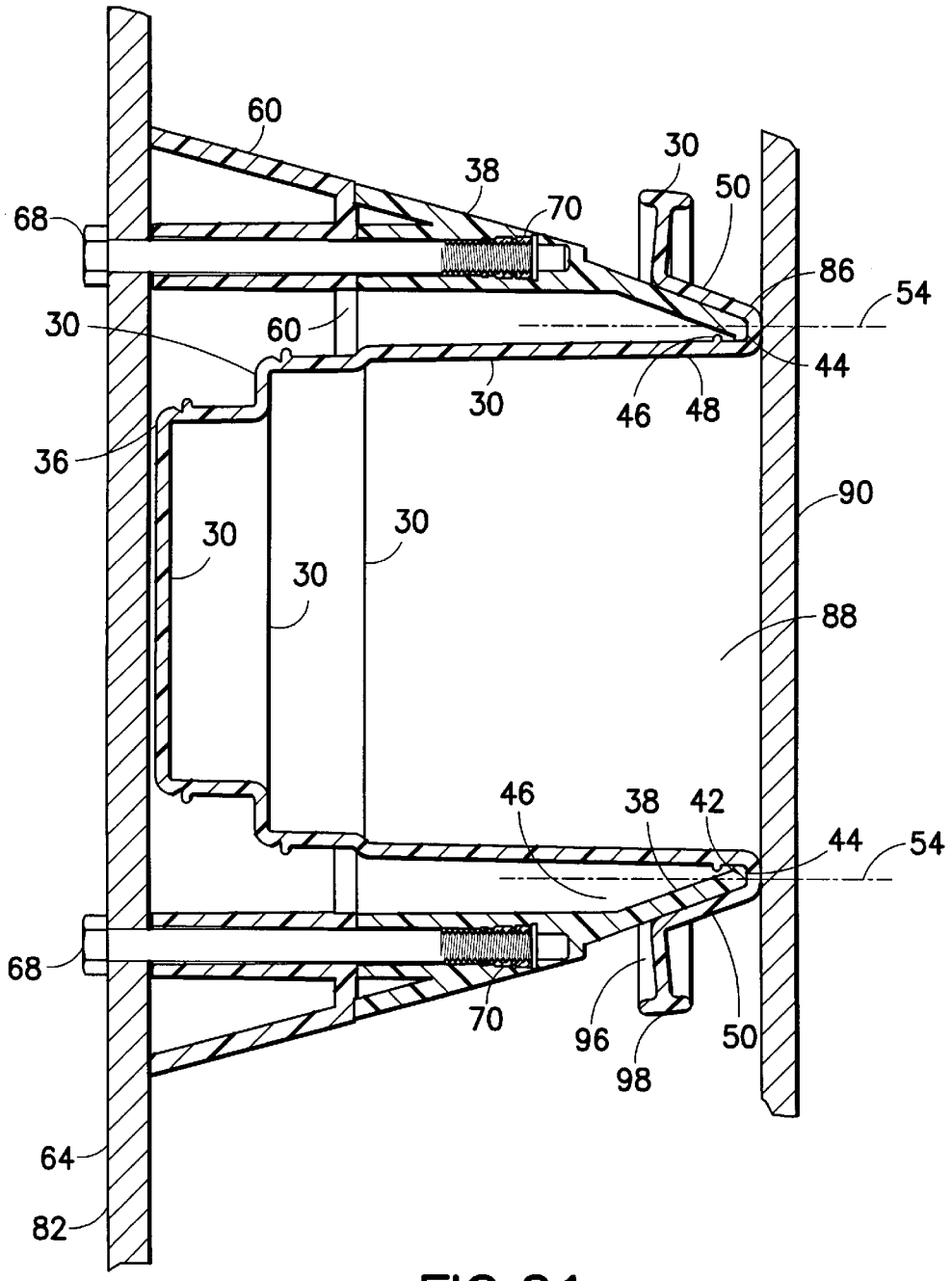
FIG. 21 is a cross section schematic view of the seal and frame of FIG. 1, less the stud receiver, mounted in the closed mold of FIG. 4 for a concrete wall.
Figure 22:
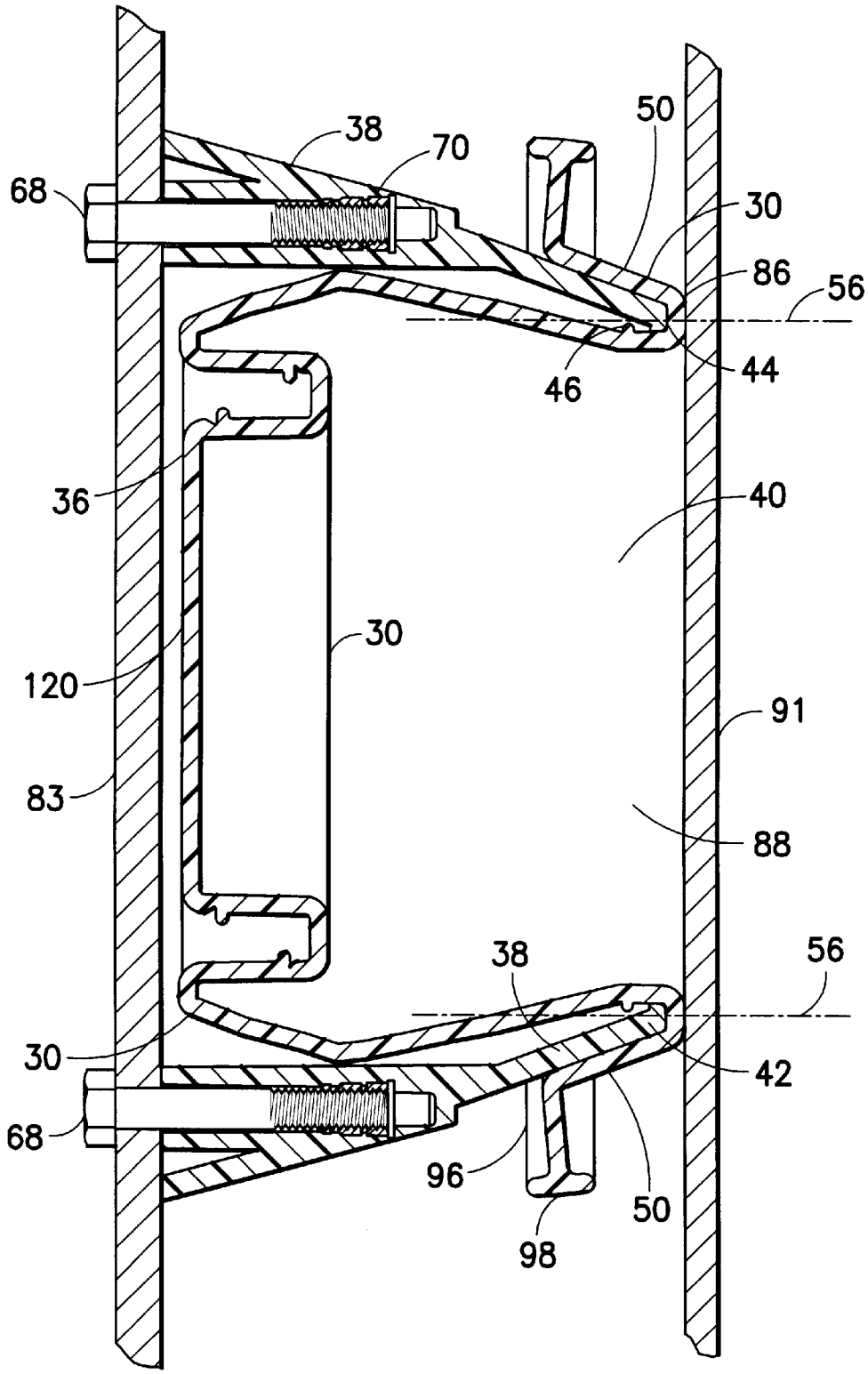
FIG. 22 is a cross section schematic view of the seal of FIG. 1, mounted on the frame of FIG. 5, mounted in a closed mold for a thinner wall than in FIG. 21.

Referring to FIGS. 21 and 22, fastener 68 screws into molded-in threaded insert 70.

In FIG. 21, back end 42 of frame 38, received in the bottom 44 of annular recess 46, taken in cross section contacts the bottom of the recess on a line 54 normal to mold wall 90 that passes through the contact of back end 86 of the seal with wall 90.

Front end 36 and wall 120 of seal 30 is adjacent to mold wall 82 which includes door 64.

In FIG. 22, only frame 38 is used, fastened to movable wall 83 of a concrete wall mold, and front end 36 of the seal which is adjacent to wall 83 of the mold is collapsed into the tubular interior 40 of the seal. Back end 42 of frame 38, received in the bottom 44 of annular recess 46, taken in cross section contacts the bottom of the recess on a line 56 normal to mold wall 91 that passes through the contact of back end 86 of the seal with wall 91.

Figure 23:
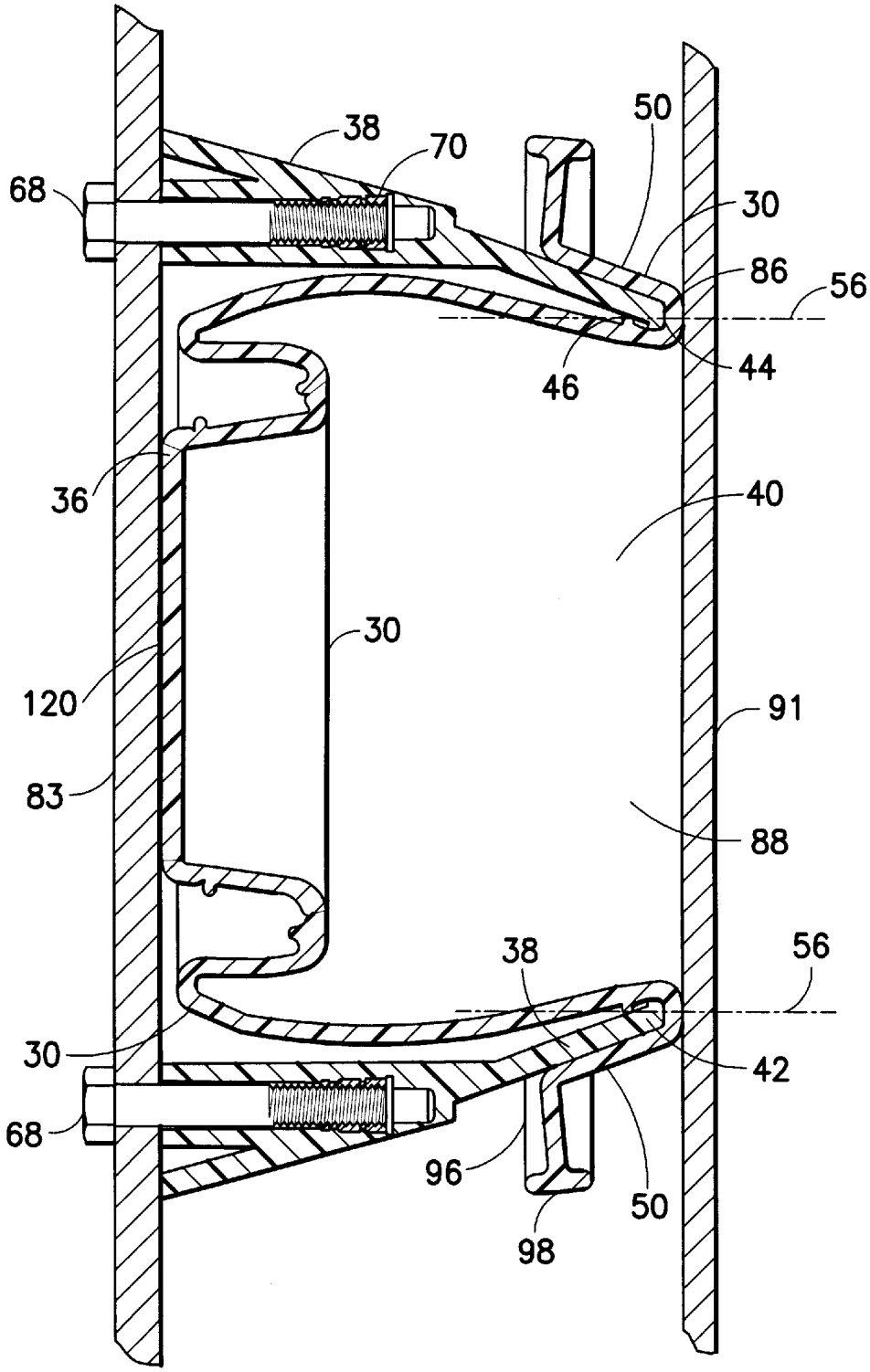
FIG. 23 is a cross section schematic view of the seal of FIG. 1 mounted on the frame of FIG. 5, mounted in a closed mold for a thinner wall than in FIG. 21.

In FIG. 23, only frame 38 is used, fastened to movable wall 83 of a concrete wall mold, and front end 36 of the seal which is adjacent to wall 83 of the mold, pressed inward by wall 83 is collapsed into the tubular interior 40 of the seal. Back end 42 of frame 38, received in the bottom 44 of annular recess 46, taken in cross section contacts the bottom of the recess on a line 56 normal to mold wall 91 that passes through the contact of back end 86 of the seal with wall 91.

Figure 24:
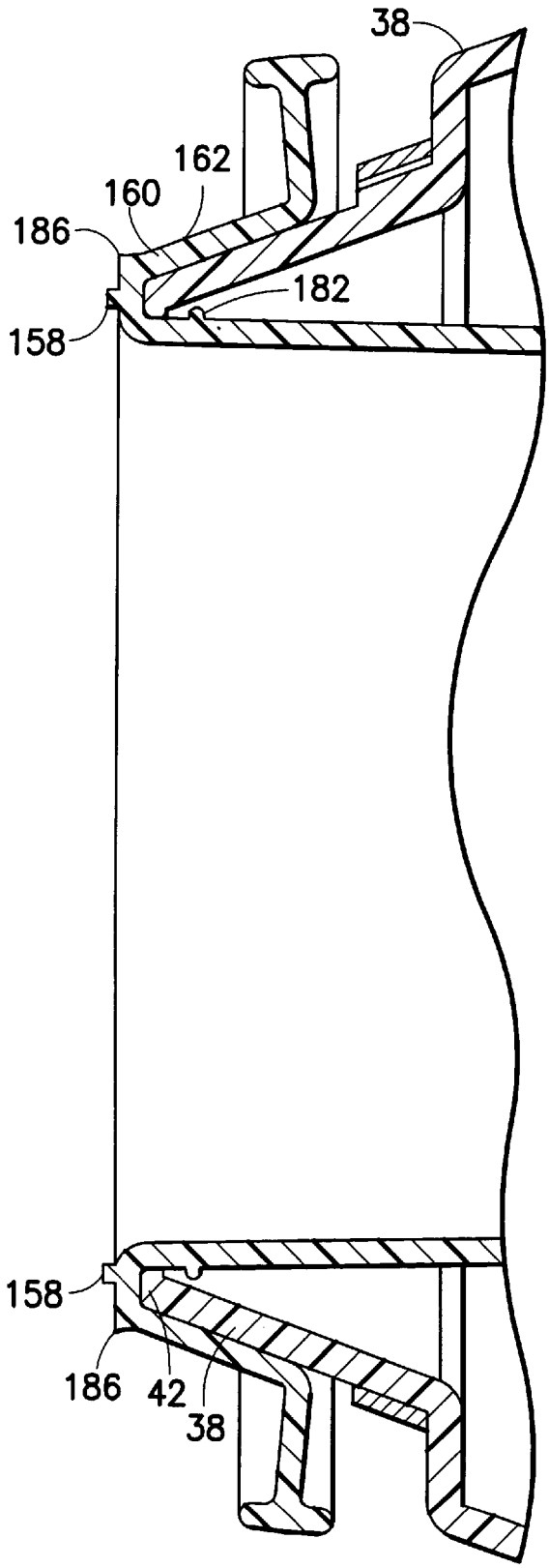
FIG. 24 is a cross section partial view of the front of another seal mounted on a frame.

Referring to FIG. 24, annular ridge 158 on seal 160 compresses to provide a seal against wall 90 when seal 160 is mounted in frame 38 and door 64 is closed, allowing for variability in the axial length of the seal and the fit of the seal against back end 42 of the frame and sealing wall 162 against frame 38.

Annular bead 182 helps keep the seal on the frame until the door is closed. Corner 186 is shaped so that the hardened concrete is not left with a sharp inwardly directed annular sharp edge that could cut or damage the seal. Preferably other recesses or corners are also shaped to avoid harmful sharp edges of concrete.

A seal cast system of the invention may be made using frames and seals of various shapes in cross section, and more or less than two separable portions.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention.

Drawing Designators (Informal List)

30 seal
34 inserted
36 front end
38 frame
40 tubular interior
42 back end of frame 38
44 bottom of annular recess 46
46 annular recess
48 tubular wall
50 annular wall
52 latch
54 line
56 line
60 frame
64 door
68 fastener
70 threaded insert
72 guide in frame 38
74 guide in frame 60
80 hinge
82 mold wall
83 mold wall
86 back end of seal
88 opening
90 mold wall
91 mold wall
92 space between walls 82 and 90
94 exposed surfaces
96 ring, radially extending annular
98 ridge, outermost annular axially extending
104 side of concrete wall 108
106 side of concrete wall 108
108 concrete wall
116 tubular portion of seal
120 wall
130 stud receiver
134 guide
136 indexing slot
140 axis of seal
142 receiver head
144 extension
146 back end
148 opening
158 annular ridge on seal 160
160 seal
162 annular wall
168 annular notch
170 tubular wall
176 annular notch
178 tubular wall
182 annular bead
186 corner

What is claimed is:

1. In a mold for a concrete container for use in a low pressure septic system, a seal cast system comprising:

a first mold wall, a second mold wall spaced from said first mold wall for receiving liquid concrete between said first mold wall and said second mold wall for forming a concrete wall of the container, a stiff tubular frame comprising a first end liquid concrete tight sealingly attached to said first mold wall between said first mold wall and said second mold wall, extending toward said second mold wall, a one piece molded flexible tubular seal comprising a closed molded first end of said seal in said tubular frame, said seal extending from a second end of said tubular frame toward said second mold wall, a second, open end of said flexible tubular seal liquid concrete tight sealingly contacting said second mold wall, the second end of said tubular frame extending toward said second mold wall into an annular recess formed by a portion of said seal folding back from the second end of said seal toward the first end of said seal, to the bottom of said recess, and radially extending means, molded on said seal, for anchoring said seal in the concrete wall when the concrete wall is formed by the first and second mold walls.

2. The seal cast system of claim 1 in which said tubular frame is made from a plurality of liquid concrete tight sealingly connected tubes.

3. In a mold for a concrete container for use in a low pressure septic system, a seal cast system comprising:

a first mold wall, a second mold wall spaced from said first mold wall for receiving liquid concrete between said first mold wall and said second mold wall for forming a concrete wall of the container, a stiff tubular frame having a first end, a second end, and an axis through the first end and the second end, the first end of said frame attached sealingly to said first mold wall between said first mold wall and said second mold wall, said frame extending axially toward said second mold wall, a one piece molded flexible tubular seal comprising a closed molded first end of said seal in said tubular frame, said seal extending axially from the second end of said tubular frame toward said second mold wall, a second, open end of said flexible tubular seal sealingly contacting said second mold wall, the second end of said tubular frame extending toward said second mold wall into an annular recess on said seal formed by a portion of said seal folding back from the second end of said seal toward the first end of said seal, to the bottom of said recess, and radially extending means, molded on said seal, for anchoring said seal in the concrete wall when the concrete wall is formed by the first and second mold walls.

4. The seal cast system of claim 3 wherein the second end of said frame is smaller than the first end of said frame, and the second end of said tubular seal is larger than the first end of said tubular seal.

5. The seal cast system of claim 3 further comprising:

said stiff tubular frame being one piece molded containing a first plurality of molded-in threaded fasteners, and a second plurality of fasteners extending from said first mold wall into said first plurality of fasteners, spaced radially from said axis.

6. The seal cast system of claim 5 wherein said plurality of fasteners extend through a movable portion of said first mold wall.

7. In a mold for a concrete container for use in a low pressure septic system, a seal cast system comprising:

a first mold wall, a second mold wall spaced from said first mold wall for receiving liquid concrete between said first mold wall and said second mold wall for forming a concrete wall of the container, a stiff tubular frame having a first end, a second end, and an axis through the first end and the second end, the first end of said frame attached sealingly to said first mold wall between said first mold wall and said second mold wall, said frame extending axially toward said second mold wall, a one piece molded flexible tubular seal comprising a first end in said tubular frame, said seal extending axially from the second end of said tubular frame toward said second mold wall, a second, open end of said flexible tubular seal sealingly contacting said second mold wall, the second end of said tubular frame extending toward said second mold wall into an annular recess on said seal formed by a portion of said seal folding back from the second end of said seal toward the first end of said seal, to the bottom of said recess, and radially extending means, molded on said seal, for anchoring said seal in the concrete wall when the concrete wall is formed by the first and second mold walls, first end of said tubular seal being closed, and an annular notch in said seal around the axis adjacent to the first end of said tubular seal for removing the closed end of said seal.

8. The seal cast system of claim 7 further comprising:

an annular molded ridge of said molded flexible tubular seal, extending axially from said second open end.

9. The seal cast system of claim 7 further comprising:

an annular molded bead of said molded flexible tubular seal, in said recess extending radially toward said tubular frame.

10. In a mold for a concrete container for use in a low pressure septic system, a seal cast system comprising:

a first mold wall, a second mold wall spaced from said first mold wall for receiving liquid concrete between said first mold wall and said second mold wall for forming a concrete wall of the container, a stiff tubular frame having a first end, a second end, and an axis through the first end and the second end, the first end of said frame attached sealingly to said first mold wall between said first mold wall and said second mold wall, said frame extending axially toward said second mold wall, a one piece molded flexible tubular seal comprising a first end in said tubular frame, said seal extending axially from the second end of said tubular frame toward said second mold wall, a second, open end of said flexible tubular seal sealingly contacting said second mold wall, the second end of said tubular frame extending toward said second mold wall into an annular recess on said seal formed by a portion of said seal folding back from the second end of said seal toward the first end of said seal, to the bottom of said recess, radially extending means, molded on said seal, for anchoring said seal in the concrete wall when the concrete wall is formed by the first and second mold walls, means for receiving a fastener, mounted on said frame, extending from said frame for anchoring in the concrete wall, contacting said second wall for receiving a fastener when said second mold wall is separated from the concrete wall, means, on said frame, for indexing said means for receiving a fastener to a predetermined position on said concrete wall.

11. In a mold for a concrete container for use in a low pressure septic system, a seal cast system comprising:

a first mold wall, a second mold wall spaced from said first mold wall for receiving liquid concrete between said first mold wall and said second mold wall for forming a concrete wall of the container, a stiff tubular frame having a first end, a second end, and an axis through the first end and the second end, the first end of said frame contacting said first mold wall attached sealingly to said first mold wall between said first mold wall and said second mold wall, said frame extending axially toward said second mold wall, a one piece molded flexible tubular seal comprising a closed molded first end of said seal in said tubular frame adjacent to said first mold wall, said seal extending axially from the second end of said tubular frame toward said second mold wall, a second, open end of said flexible tubular seal sealingly contacting said second mold wall, the second end of said tubular frame extending toward said second mold wall into an annular recess on said seal formed by a portion of said seal folding back from the second end of said seal toward the first end of said seal, to the bottom of said recess, and radially extending means, molded on said seal, for anchoring said seal in a concrete wall formed by the first and second mold walls.

12. In a mold for a concrete container for use in a low pressure septic system, a seal cast system comprising:

a first mold wall, a second mold wall spaced from said first mold wall for receiving liquid concrete between said first mold wall and said second mold wall for forming a concrete wall of the container, a stiff tubular frame having a first end, a second end, and an axis through the first end and the second end, the first end of said frame attached sealingly to said first mold wall between said first mold wall and said second mold wall, said frame extending axially toward said second mold wall, a one piece molded flexible tubular seal comprising a first end in said tubular frame, said seal extending axially from the second end of said tubular frame toward said second mold wall, a second, open end of said flexible tubular seal sealingly contacting said second mold wall, the second end of said tubular frame extending toward said second mold wall into an annular recess on said seal formed by a portion of said seal folding back from the second end of said seal toward the first end of said seal, taken in cross section, the second end of said tubular frame contacting the bottom of said recess on a line normal to said second mold wall that passes through the contact of said second end of said seal with said second mold wall, radially extending means, molded on said seal, for anchoring said seal in the concrete wall when the concrete wall is formed by the first and second mold walls, means for receiving a fastener, mounted on said frame, extending from said frame for anchoring in the concrete wall, contacting said second mold wall for receiving a fastener when said second mold wall is separated from the concrete wall, means, on said frame, for indexing said means for receiving a fastener to a predetermined position on said concrete wall.

13. In a mold for a concrete container, a seal cast system comprising:

a first mold wall, a second mold wall spaced from said first mold wall for receiving liquid concrete between said first mold wall and second mold wall for forming a concrete wall of the container;

a tubular frame disposed in said mold having a first end, attached to said first mold wall, and a second, open end;

a generally annular, molded flexible seal comprising;

a first, generally annular wall and a second generally annular wall, said walls connected by a juncture portion and define an annular recess having a bottom;

a closed molded end of said first, generally annular wall being disposed in said tubular frame, at least a portion of said frame disposed between said first annular wall and said second annular wall of said seal with said second end of said frame disposed in the bottom of said recess, wherein said second generally annular wall overlies at least a portion of said first generally annular wall, and said juncture portion defines an open end of said seal, and wherein said open end of said seal contacts said second mold wall.

14. A seal cast system as claimed in claim 13 wherein said first end of said frame is in concrete tight sealing contact with said first mold wall.

15. A seal cast system as claimed in claim 13 wherein said frame is rigid.

16. In a mold for a concrete container, a seal cast system comprising:

a first mold wall, a second mold wall spaced from said first mold wall for receiving liquid concrete between said first mold wall and second mold wall for forming a concrete wall of the container;

a tubular frame disposed in said mold having a first end, attached to said first mold wall, and a second, open end;

a generally annular, molded flexible seal comprising;

a first, generally annular wall and a second generally annular wall, said walls connected by a juncture portion and define an annular recess having a bottom;

said first, generally annular wall being disposed in said tubular frame, at least a portion of said frame disposed between said first annular wall and said second annular wall of said seal with said second end of said frame disposed in the bottom of said recess, wherein said second generally annular wall overlies at least a portion of said first generally annular wall and said juncture portion defines an open end of said seal, and wherein said open end of said seal contacts said second mold wall, wherein said first generally annular wall is generally cylindrical and said second generally annular wall defines a truncated cone that diverges from said juncture portion.

17. A seal cast system as claimed in claim 16 wherein said generally cylindrical wall includes a closed end spaced from said connection to said juncture portion.

18. A seal cast system as claimed in claim 17 wherein said closed end is in contact with said first mold wall.

19. In a mold for a concrete container, a seal cast system comprising:

a mold having a first mold wall, and a second mold wall, spaced from said first mold wall for receiving liquid concrete between said first mold wall and said second mold wall for forming a concrete wall of the container;

a tubular frame disposed in said mold having a first end, attached to said first mold wall, and a second, open end;

a generally annular, molded in one piece flexible seal comprising:

a first, generally annular wall and a second generally annular wall, said walls connected by a juncture portion and define an annular recess having a bottom;

one of said generally annular walls being disposed in said tubular frame, said one of said generally annular walls having a closed molded end in said tubular frame, said juncture portion defining an open end of said seal and being in contact with said second mold walls, wherein said second end of said frame extends into said recess; and wherein the other of said generally annular walls is in sealing contact with said frame along the entire length of said other of said generally annular walls.

20. A seal cast system as claimed in claim 19 wherein said frame is rigid and wherein said second, open end of said frame, extends to the bottom of said recess.

21. A mold for a concrete container as claimed in claim 19 wherein said second end of said frame extends to the bottom of said annular recess.

22. In a mold for a concrete container, a seal cast system comprising:

a mold having a first mold wall, and a second mold wall, spaced from said first mold wall for receiving liquid concrete between said first mold wall and said second mold wall for forming a concrete wall of the container;

a tubular frame disposed in said mold having a first end, attached to said first mold wall, and a second, open end;

a generally annular, molded flexible seal comprising:

a first, Generally annular wall and a second generally annular wall, said walls connected by a juncture portion and define an annular recess having a bottom;

one of said generally annular walls being disposed in said tubular frame, said juncture portion defining an open end of said seal and being in contact with said second mold wall, wherein said second end of said frame extends into said recess; and wherein the other of said generally annular walls is in sealing contact with said frame along the entire length of said other of said generally annular walls, wherein said first end of said frame is in concrete tight sealing contact with said first mold wall; and wherein one of said generally annular walls is generally cylindrical and the other of said generally annular walls is in the form of a truncated cone.

23. A mold for a concrete container as claimed in claim 22 wherein said second end of said frame extends to the bottom of said annular recess.

24. A mold for a concrete container as claimed in claim 22 further comprising:

an annular molded ridge of said molded flexible seal, extending axially from an outer surface of said juncture portion.

25. In a mold for a concrete container, a seal cast system comprising:

a mold having a first mold wall, and a second mold wall, spaced from said first mold wall for receiving liquid concrete between said first mold wall and said second mold wall for forming a concrete wall of the container;

a tubular frame disposed in said mold having a first end, attached to said first mold wall, and a second, open end;

a generally annular, molded flexible seal comprising:

a first, generally annular wall and a second generally annular wall, said walls connected by a juncture portion and define an annular recess having a bottom;

one of said generally annular walls being disposed in said tubular frame, said juncture portion defining an open end of said seal and being in contact with said second mold wall, wherein said second end of said frame extends into said recess, and wherein the other of said generally annular walls is in sealing contact with said frame along the entire length of said other of said generally annular walls.

wherein said second generally annular wall overlies at least a portion of said first generally annular wall and said first generally annular wall is generally cylindrical and said second generally annular wall defines a truncated cone that diverges from said juncture portion.

26. A seal cast system as claimed in claim 25 wherein said generally cylindrical wall includes a closed end spaced from said connection to aid juncture portion.

* * * * *